US005857741A

United States Patent [19]

Anderson

[11] Patent Number: 5,857,741

[45] Date of Patent: Jan. 12, 1999

[54] TAILGATE TABLE AND CHAIRS

[76] Inventor: Thomas J. Anderson, 6293 Morris Hill, Boise, Id. 83704

[21] Appl. No.: 998,493

[22] Filed: Dec. 26, 1997

[51] Int. Cl.[6] ..... A47B 39/00

[52] U.S. Cl. ..... 297/170; 108/44; 224/521; 297/217.1

[58] Field of Search ..... 297/170, 171, 297/172, 174, 217.1; 108/44; 224/518, 521; 280/762

[56] References Cited

U.S. PATENT DOCUMENTS

| | | | |
|---|---|---|---|
| 3,348,879 | 10/1967 | Merola | 297/170 X |
| 4,381,069 | 4/1983 | Kreck | 224/42.44 |
| 5,038,983 | 8/1991 | Tomososki | 224/42.43 |
| 5,224,636 | 7/1993 | Bounds | 224/521 X |
| 5,397,147 | 3/1995 | Ducharme et al. | 280/415.1 |
| 5,451,088 | 9/1995 | Broad | 296/26 |
| 5,482,424 | 1/1996 | Jones et al. | 224/521 X |
| 5,520,315 | 5/1996 | Graham | 224/521 |
| 5,615,813 | 4/1997 | Ouellette | 224/405 |
| 5,752,639 | 5/1998 | Rice | 224/521 |

*Primary Examiner*—Peter R. Brown
*Attorney, Agent, or Firm*—Frank J. Dykas

[57] ABSTRACT

A vehicle trailer hitch mounted table and chairs which can be used for tailgate parties. The seats on the chairs swivel, and the table includes a dismountable umbrella. The table, chairs and umbrella can be dismounted from the vehicle, or can be changed to a traveling position in which the umbrella and table top are removed, and the seats are attached to the frame of the device, which is still mounted to the trailer hitch of the vehicle.

8 Claims, 4 Drawing Sheets

TAILGATE TABLE AND CHAIRS

BACKGROUND OF THE INVENTION

1. Field of the Invention

The present invention generally relates to a table and chair apparatus, and more particularly to a table and chair device which attaches to a trailer hitch of a vehicle.

2. Background Information

Picnics and outdoor parties have long been a favorite pastime of Americans. In recent years, a particular type of outdoor party or picnic has become increasingly popular, and is known as the tailgate party. The typical tailgate party might occur in the parking lot outside a sports arena, before the sports exhibition has begun. These tailgate parties typically involve consuming food and beverages which may not be available inside the sporting arena, and which add to the enjoyment of the sporting event. Consuming these foods and beverages normally takes place in or around the vehicles of the participants, and the tailgate of a station wagon or a pickup truck may become the impromptu kitchen counter and seating bench of the tailgate party.

Another use for a vehicle mounted table and chair is when camping. Sport utility vehicles, pickups, station wagons, and RVs are used in camping, with or without a towed trailer or camper. For camping situations, an attached table and chair can add a comfort feature to camping, or provide a lunch spot while on mountain biking, hiking, or other excursions involving vehicles.

Although table and chair devices have been used for millennia, none are specially adapted for use in the tailgate party or camping setting. The prior art contains a number of devices which are designed to mount on a trailer hitch mount of a vehicle. These include work tables for performing a technician's work in the field, load stabilizers for stabilizing a long load of pipes or lumber, bike racks, outboard motor mounts, and cargo carrier platforms. None of these devices are specifically adapted for use in a tailgate party setting, attached to a vehicle.

Accordingly, it is an object of the invention to provide a table with attached chairs, all of which mount on a vehicle. It is another object of the invention that such a device mount in the towing hitch of the vehicle. It is another object of the invention that such device is removable, and easily storable in a traveling position. It is another object of the invention that the table and chairs are mountable on the rear of the vehicle when the tailgate is in the down position.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The foregoing and other objects are obtained by a hitch mounted table and seat. The hitch mounted table and seat form a table and seat device which can be mounted to the towing hitch of a vehicle, and is adapted for mounting when the tailgate of a pickup, station wagon or other vehicle is in the down position. The hitch mounted table and seat include a frame, a table tube, a table top, a seat tube, a seat frame, and seats.

The frame is the part which mounts on the hitch. It has a hitch end and an outfacing end, with a hitch insert on the hitch end and a seat frame receiver on the outfacing end. The table top forms a generally horizontal surface, and is attached to a table tube. The table tube is attached to the frame, between its two ends. The table tube may have an angled section connected to a vertical section, it may be a curved section, or it may just have a vertical section. One or more seats are provided, and they may have backs attached or not. They can be provided with a mechanism which allows each seat to swivel independently. Each seat is attached to a seat tube, which itself attaches to the frame in one or more seat frame receivers which is provided on the frame. The hitch insert of the frame is inserted into the hitch of a vehicle and locked in place with a pin, a bolt, a latch or other locking device.

The hitch mounted table described above is preferably made of rigid, rectangular tubing, such as steel, but rigid circular tubing, oval tubing, channel or angle shapes, or other materials could be equally suitable. The hitch-mounted table described above can include a picnic umbrella, which attaches to the table top, or to another part of the device. One or more seats can be utilized, but the optimal design includes two seats, each of which swivel independently. Each may also rotate independently on the seat tube around the seat frame receiver. Seats may be with or without backs.

The hitch mounted table and seats may be disassembled and removed from the vehicle. In storage, the frame may be inserted deeper into the towing hitch of the vehicle, the table top and umbrella may be removed, and the seat frame, with its attached seat posts and seats, may be placed on the end of a table tube. The seat backs may also fold into a flat configuration.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
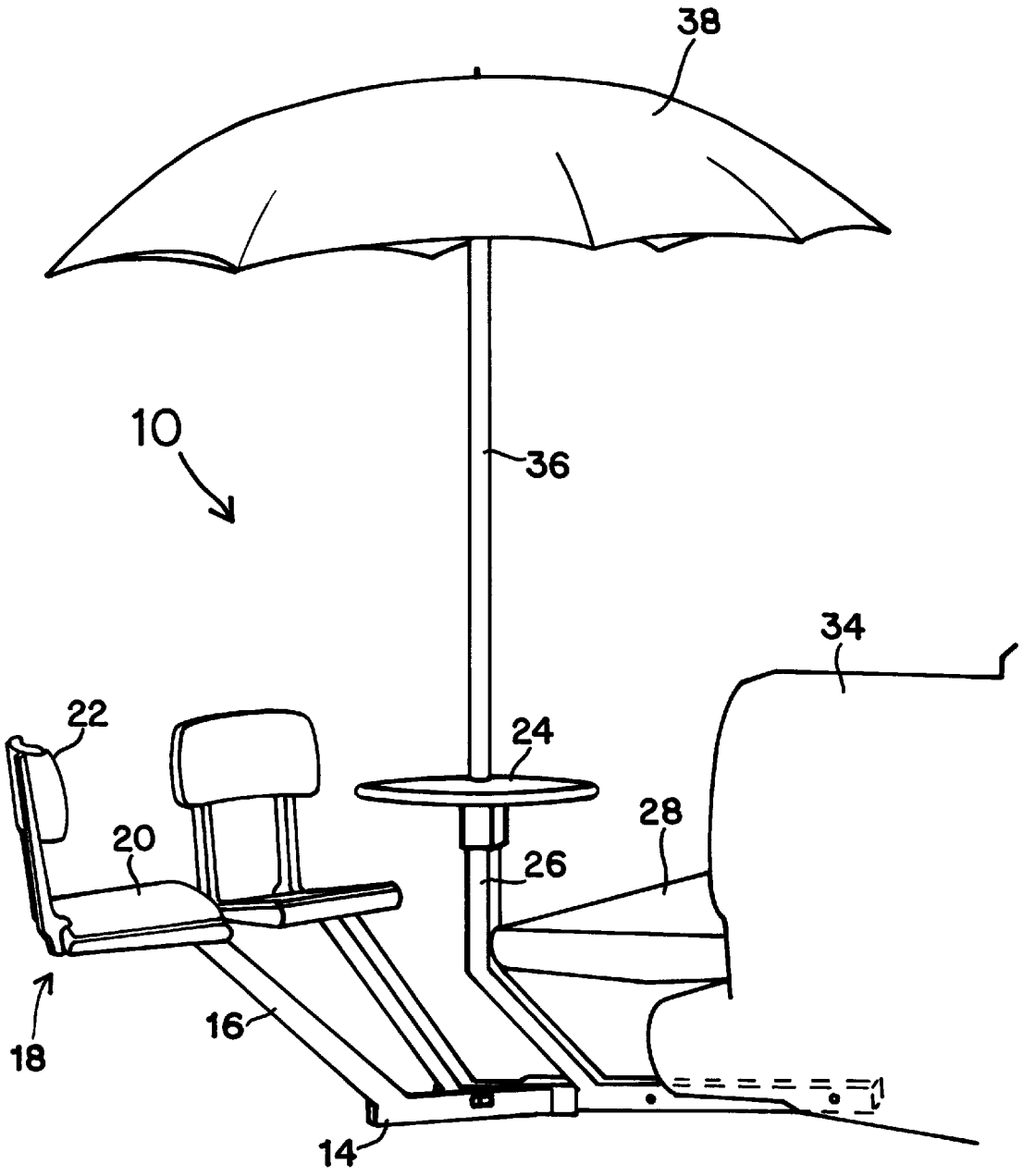
FIG. 1 is a perspective view of the tailgate table and chairs.
Figure 2:
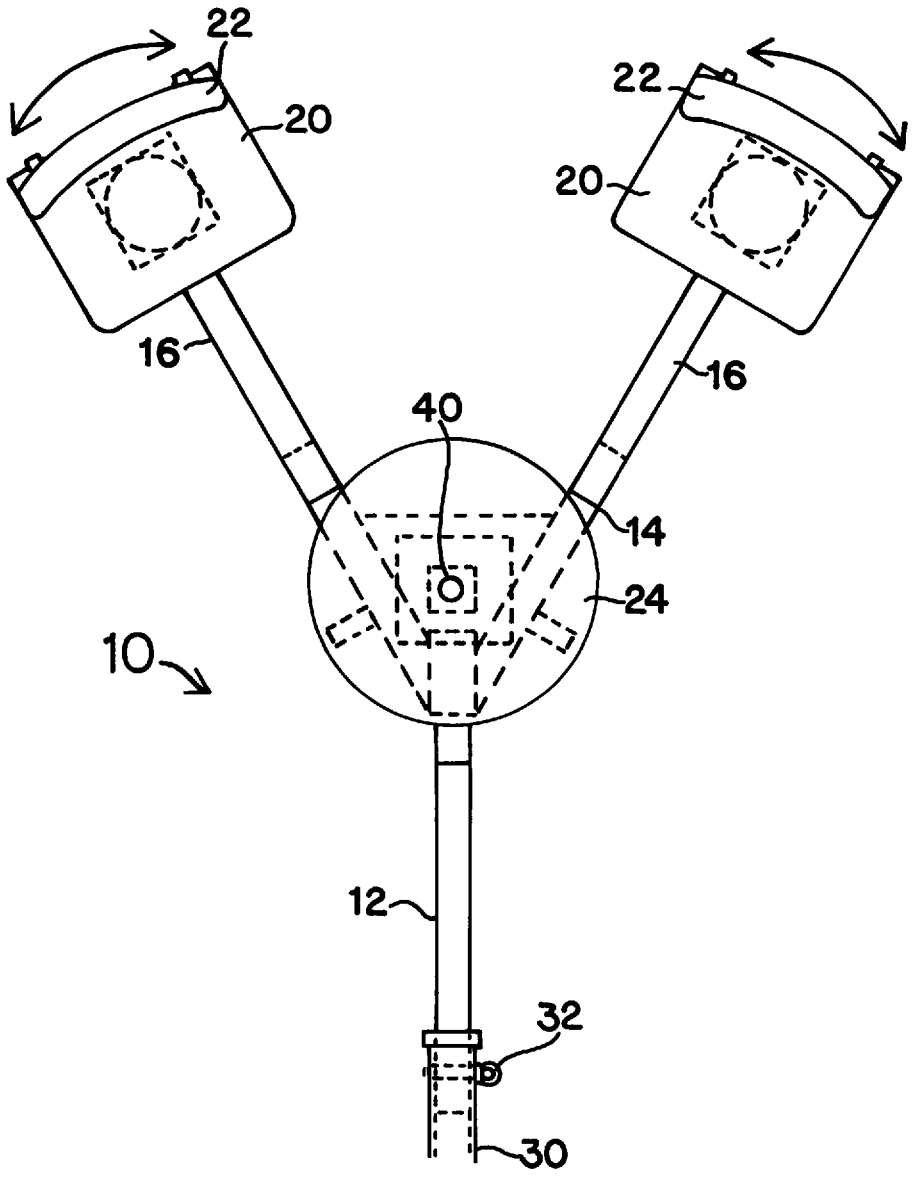
FIG. 2 is a top view of the tailgate table and chairs.
Figure 3:
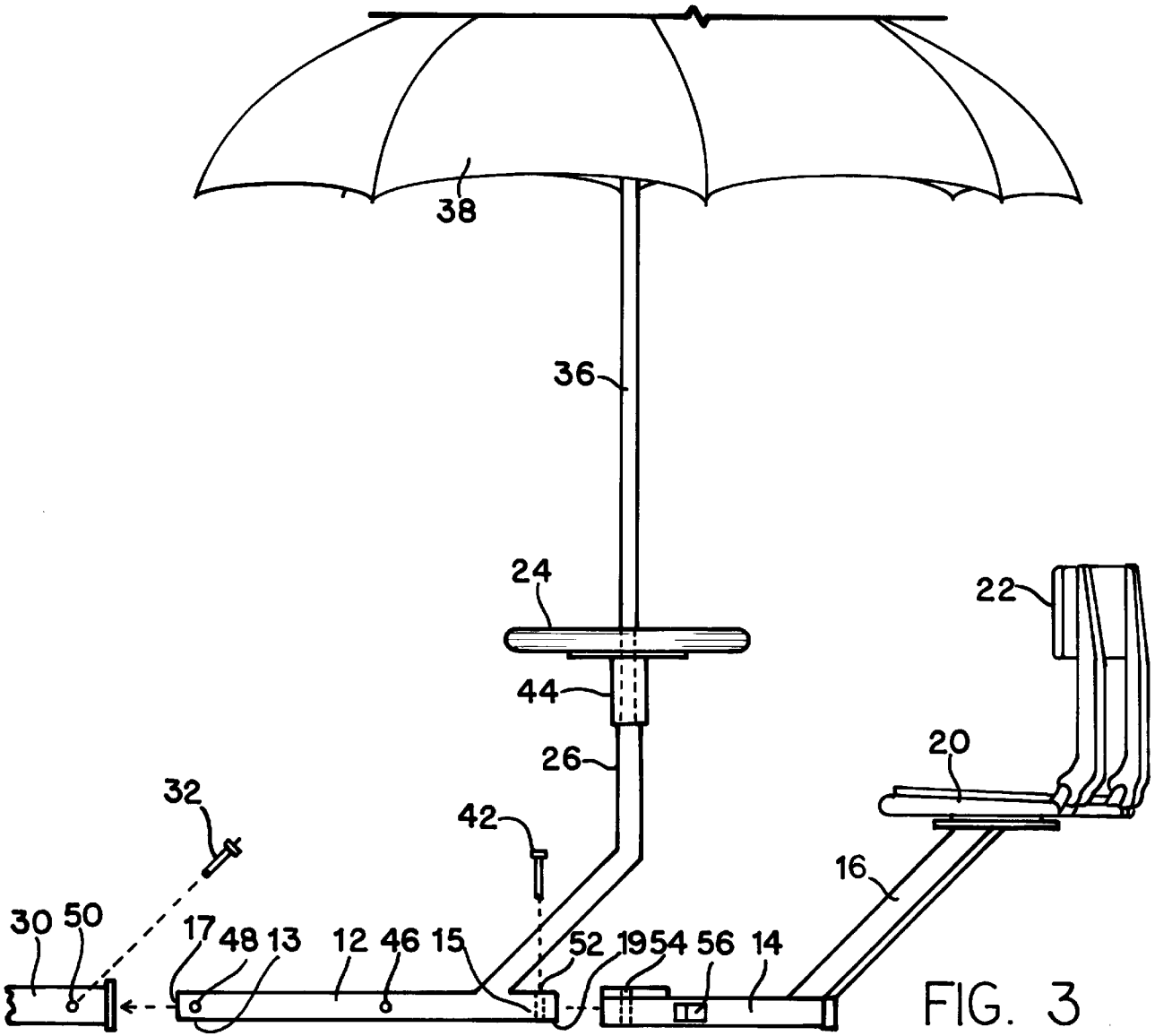
FIG. 3 is a side view of the tailgate table and chairs.

The preferred embodiment of the invention is shown in FIGS. 1 through 4. In the preferred embodiment, the tailgate table and chair 10 is made of rectangular steel tubing and is mounted into the hitch receiver 30 of a vehicle 34. The tailgate table and chair 10 includes a frame 12. As shown in FIG. 3, the frame 12 has a hitch end 13 and an out facing end 15, in which the hitch end 13 is oriented toward the vehicle hitch receiver 30, and the out facing end 15 is oriented away from the hitch receiver 30. On the hitch end 13 of the frame 12 is located a hitch insert 17, which is designed to fit within a hitch receiver 30 of a vehicle. On the out facing end 15 is located a seat frame receiver 19, which is designed to receive and attach to a seat frame 14. Attached to said frame 12 is a table tube 26, which attaches to the frame 12 between the hitch end 13 and the out facing end 15. The table tube 26 extends generally upward to support a table top 24. The table tube 26 in the preferred embodiment includes two sections, a lowered angle section, and an upper vertical section, as shown in FIG. 3. Other configurations of table tubes are possible, such as curved or vertical. The table tube extends up and supports a table top 24. The table top 24 attaches to the table tube 26 and forms a generally horizontally disposed surface, which is available for use by the user for holding food or beverage containers for the tailgate party. Attached to the seat frame is one or more seat tubes. In the preferred embodiment of the invention, there are two seat tubes 16, each seat tube 16 having an attached seat 18. Although the seat 18 may include just a seat bottom 20, each seat 18 preferably also includes a seat back 22, as shown in FIGS. 1 through 3. These seats swivel 360° in the preferred embodiment.

A frame 12 also includes a first frame hole 48 and a second frame hole 46. Either of these holes can be made to correspond with hitch receiver hole 50, which is shown in FIG. 3. When the holes are so aligned, hitch pin 32 is passed through the holes and locks the device in place. Located on seat frame receiver 19 is a seat frame hole 52, which coincides with a second seat frame hole 54 in the seat frame 14. When these two holes are aligned, seat frame pin 42 in table top 24 is located an umbrella hole 40, which is shown in FIG. 2. Umbrella post 36 is inserted into umbrella hole 40 in table top 24, to support the umbrella. Table top 24 is mounted to table tube 26 by the use of table top 10 which passes through corresponding holes in table top 24 and table tube 26. Seat frame 14 also has a pair of foot rests 56 located on either side of seat frame 14.

The tailgate table and chairs 10 is shown in the mounted position in FIG. 1, and the sequence of mounting is shown in FIG. 3. In that sequence, the frame 12 is inserted into the hitch receiver 30, and hitch pin 32 anchors it in place. The appropriate frame hole is used so that the tailgate 28 of the vehicle 34 can be lowered, as shown in FIG. 1. Although the drawings show only a first frame hole 48 and a second frame hole 46, it is to be understood that more frame holes are possible, and a frame hole position to allow lowering of the tailgate 28 or clearance behind a spare tire (not shown) when in the traveling position would be utilized. Into seat frame receiver 19 is inserted seat frame 14, with its attached seats 18. Table top 24 is mounted to table tube 26 by the use of table top 24. Umbrella post 36, with its attached umbrella top 38, is mounted into umbrella hole 40 in table top 24.

Figure 4:
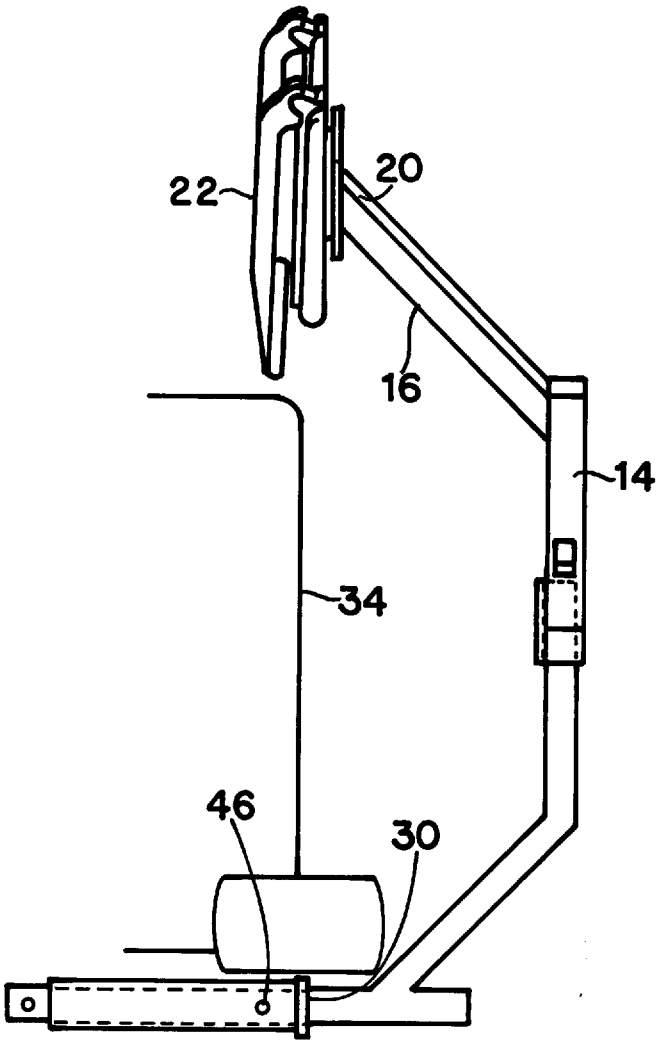
FIG. 4 is a side view of the tailgate table and chairs in a traveling position.

The tailgate table and chairs 10 are disassembled in the reverse order, and may be mounted in a traveling position for convenient transporting of the device. To convert the configuration shown in FIG. 1 to the traveling position shown in FIG. 4, hitch pin 32 is removed and the frame 12 is inserted deeper into hitch receiver 30. When the frame 12 is inserted so that the table tube 26 is as close to the vehicle 34 or spare tire as possible, then the second frame hole 46 should be aligned with the hitch receiver hole 50, and the hitch pin 32 is reinserted. The umbrella post 36 is removed from the umbrella hole 40, and the umbrella top is folded. The table top 24 is removed from the table tube 26 by the removal of table top pin 44. Seat frame 14 is then mounted on the table tube 24, as shown in FIG. 4. In this configuration, the seats 18 and the seat bottom 20 are in a vertical position. In this configuration, there is minimal extension from the rear of the vehicle 34, allowing safe and convenient transportation of the device 10. Optionally, a 1½ inch tube can be mounted on the seat frame to allow a bike rack to be mounted on the device 10, so that in the traveling position a bike rack and bikes can be attached to the device 10.

While there is shown and described the present preferred embodiment of the invention, it is to be distinctly understood that this invention is not limited thereto but may be variously embodied to practice within the scope of the following claims.

I claim:

1. A hitch mounted table and seat, for use with a vehicle having a hitch receiver, comprising:

a frame comprising a hitch end and an out-facing end, with a hitch insert adapted for use with said vehicle hitch receiver on said hitch end, and a seat frame receiver on said out-facing end;

a table tube attached to said frame between said hitch end and said out-facing end, and extending upward to support a table top;

a table top which attaches to said table tube, and which forms a generally horizontally disposed surface;

a seat frame attached to said seat frame receiver of said frame, and to which is attached one or more seat tubes which have a seat for sitting on, ; and one or more seats for sitting on and attaching to said seat tube, and through said seat frame and frame, to said hitch.

2. The hitch mounted table and seat of claim 1 which further comprises a frame made of rigid tubing.

3. The hitch mounted table and seat of claim 1 which further comprises an umbrella which attaches to said table top.

4. The hitch mounted table and seat of claim 1 which further comprises two seats which mount on said seat tubes.

5. The hitch mounted table and seat of claim 1 in which a seat back is attached to said seats.

6. A hitch mounted table and seat, for use with a vehicle having a hitch receiver, comprising:

a frame made of rigid tubing comprising a hitch end and an out-facing end, with a hitch insert adapted for use with said vehicle hitch receiver on said hitch end, and a seat frame receiver on said out-facing end;

a table tube attached to said frame between said hitch end and said out-facing end, and extending upward to support a table top;

a table top which attaches to said table tube, and which forms a generally horizontally disposed surface;

a seat frame attached to said seat frame receiver of said frame, and to which is attached two seat tubes with two seats attached to said seat tubes;

a seat tube for attaching to said seat frame and said seats; and two seats for sitting on and attaching to said seat tube, and through said seat frame and frame, to said hitch.

7. The hitch mounted table and seat of claim 6 which further comprises an umbrella which attaches to said table top.

8. The hitch mounted table and seat of claim 6 in which said seats include an attached seat back.

* * * * *